US007721435B2

(12) United States Patent
Stokes

(10) Patent No.: US 7,721,435 B2
(45) Date of Patent: May 25, 2010

(54) METHOD OF SECURING A COMPONENT IN AN ENGINE

(75) Inventor: Simon H Stokes, Lincoln (GB)

(73) Assignee: Rolls-Royce PLC, London (GB)

( * ) Notice: Subject to any disclaimer, the term of this patent is extended or adjusted under 35 U.S.C. 154(b) by 657 days.

(21) Appl. No.: 11/642,674

(22) Filed: Dec. 21, 2006

(65) Prior Publication Data

US 2007/0171406 A1 Jul. 26, 2007

(30) Foreign Application Priority Data

Jan. 24, 2006 (GB) ..... 0601327.0

(51) Int. Cl.

| | |
|---|---|
| ***B21K 25/00*** | (2006.01) |
| ***B23P 6/00*** | (2006.01) |
| ***B23Q 17/00*** | (2006.01) |
| ***F01B 25/26*** | (2006.01) |
| ***G01N 21/00*** | (2006.01) |

(52) U.S. Cl. ..... 29/889.2; 29/889.1; 29/407.04; 356/241.1; 356/241.4; 356/241.5; 356/241.6; 415/118

(58) Field of Classification Search ..... 29/889.2, 29/889.21, 458, 527.2, 889.1, 407.04; 356/241.1, 356/241.4, 241.5, 241.6; 415/118; 73/112.01, 73/112.05

See application file for complete search history.

(56) References Cited

U.S. PATENT DOCUMENTS

| | | | | |
|---|---|---|---|---|
| 4,239,451 | A * | 12/1980 | Bouru | 415/173.7 |
| 4,735,501 | A * | 4/1988 | Ginsburgh et al. | 356/241.1 |
| 5,102,221 | A | 4/1992 | Desgranges et al. | |
| 6,095,971 | A | 8/2000 | Takahashi | |
| 6,725,542 | B1 * | 4/2004 | Maguire | 29/890.01 |

FOREIGN PATENT DOCUMENTS

| | | |
|---|---|---|
| GB | 2 019 221 A | 10/1979 |
| GB | 2 033 973 A | 5/1980 |
| WO | WO 00/06336 A1 | 2/2000 |

* cited by examiner

*Primary Examiner*—David P Bryant
*Assistant Examiner*—Alexander P Taousakis
(74) *Attorney, Agent, or Firm*—Oliff & Berridge PLC

(57) ABSTRACT

A method of securing a releasable component in an assembled engine by inserting a conduit through an aperture in a casing of the engine, the conduit being carried by a borescope and directing the borescope to the releasable component, and supplying an adhesive onto the releasable component through the conduit.

22 Claims, 3 Drawing Sheets

Unglued lockplug

Glued Lockplug

= Adhesive Location

METHOD OF SECURING A COMPONENT IN AN ENGINE

This invention concerns a method of maintaining an engine and in particular a method of securing a releasable component in an assembled engine.

It is known for releasable components in an engine to work loose during service and potentially damage other components in the engine. Where this happens it is necessary to remove the engine and replace the component and any other components that may be held in place by the releasable component. It is an object of the present invention to seek to provide an improved method of securing a releasable component in the engine.

Sometimes, the design of a releasable component necessitates its replacement. Such replacement is preferably done at an authorised service interval, but occasionally authorities require its replacement between service intervals. This is inconvenient to the aircraft owner and can create logistical problems. It is an object of the present invention to seek to provide a method of extending the period within which a releasable component in an engine can be replaced.

According to the present invention there is provided a method of securing a releasable component in an assembled engine, the method comprising the steps: inserting a conduit through an aperture in a casing of the engine, the conduit being carried by a borescope, directing the borescope to the releasable component, and supplying an adhesive onto the releasable component through the conduit.

The releasable component may be a lock plug for a turbine. The casing may be a turbine case.

Embodiments of the present invention will now be described by way of example only and with reference to the accompanying drawings, in which:—

Figure 1:
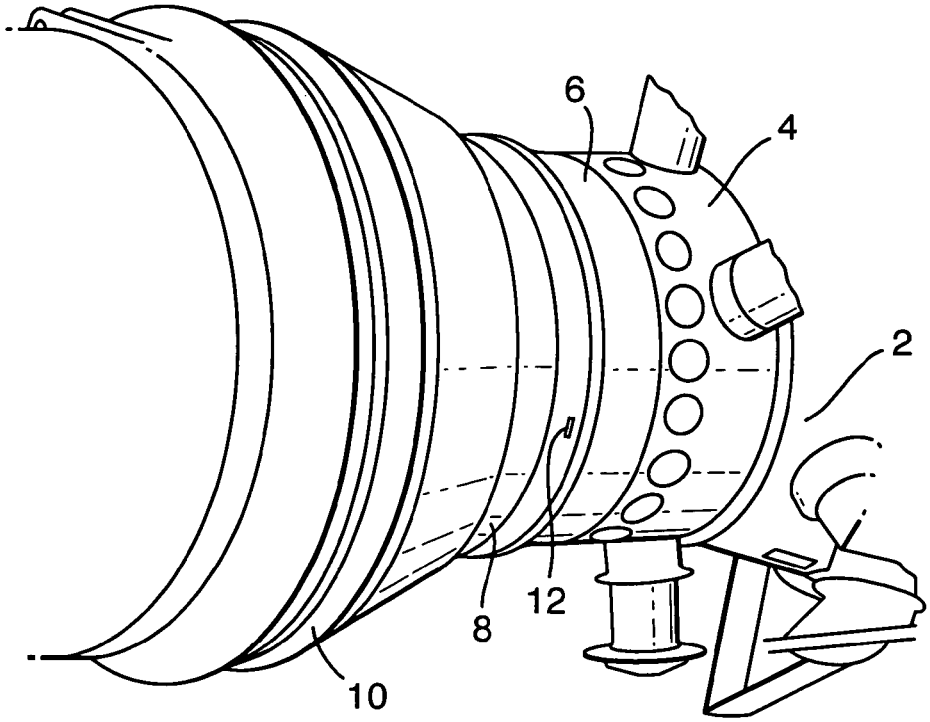
FIG. 1 is a perspective view of an engine core.

FIG. 1 depicts a perspective view of an engine core. The core is contained within a series of casings including, in axial flow order, the compressor casing 2, the combustor casing 4, the high pressure (HP) turbine casing 6, the intermediate pressure (IP) turbine casing 8, and the low pressure (LP) turbine casing 10.

The HP, LP and IP casings form the outer structure of the turbine and enclose the hot gasses exiting the combustor. They must be sufficiently strong to contain the internal pressures of the turbine and transmit and react the axial and torsional loads imposed by the turbine assembly.

Consequently, the casings are typically formed from forged steel or nickel alloys. With the exception of access ports 12 they are unitary and their location within the engine makes them relatively inaccessible.

Figure 2:
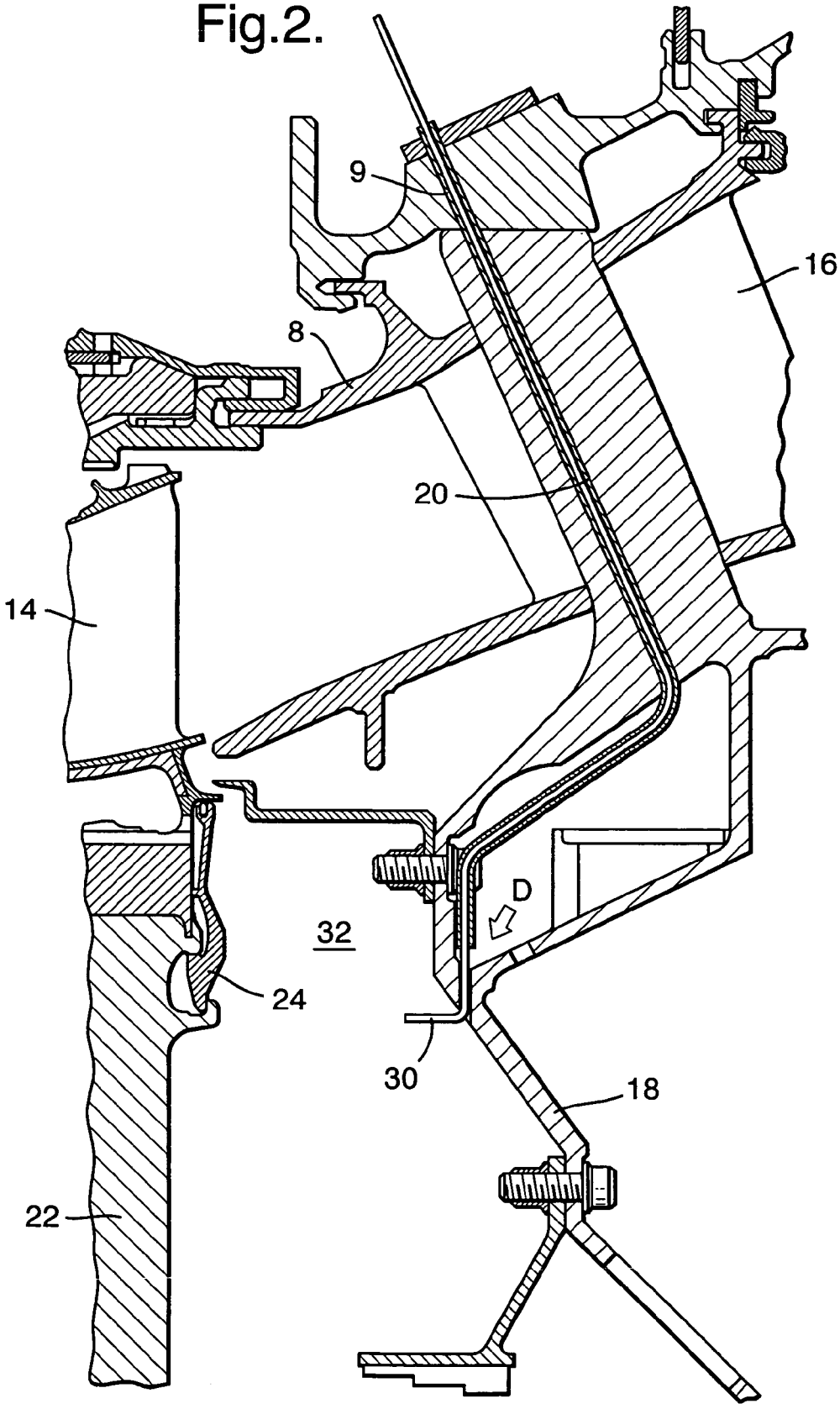
FIG. 2 is a cross-section through the high-pressure turbine of a gas turbine engine.

FIG. 2 shows a cross-section through a portion of the turbine assembly of a gas turbine engine. The section includes, in axial flow order, a high-pressure turbine blade 14 and an intermediate-pressure (IP) nozzle guide vane 16 and (not shown) an intermediate-pressure turbine blade.

The turbine assembly is mounted downstream of the combustor where compressed, high temperature products of the combustion process are expanded through the turbine to a lower temperature, less compressed state. The turbine extracts energy from the gas to rotate the turbine blades and disc assembly, which then drives the compressor via a centrally rotating shaft.

A typical turbine assembly can be broken down into five main component types: casings and structures, discs, shafts, nozzle guide vanes (NGVs) and blades.

The structure 18 shown connects the IP casing 8 to the internal shaft bearing supports, transmitting the bearing loads into the case and stiffening the assembly. A guide tube 20 for a borescopes is provided as part of the structure.

NGVs are static components that direct the flow of the working fluid onto the rotatable blades. The NGV has a hollow portion through which the guide tube 20 is mounted.

Turbine blades 14 are mounted to turbine discs 22 via a fir-tree root, or some other fixing arrangement. The root segments can leak air that will bypass the turbine blade, and consequently not contribute to the work of the engine, thus reducing the overall efficiency of the engine. A seal plate 24 is attached to the turbine discs that prevents the leakage of air and also served to maintain the turbine blades in position. The seals are held in place by locking plug.

Figure 3:
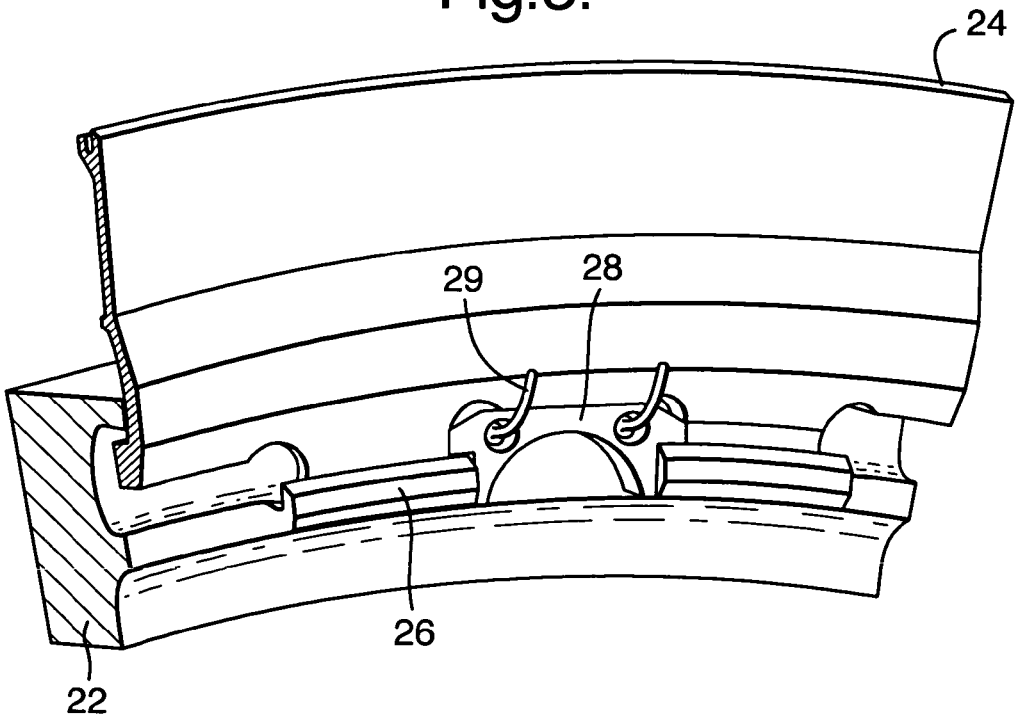
FIG. 3 depicts a HP turbine disc, seal plate and locking plug assembly.

The disc/seal/locking plug arrangement is depicted in FIG. 3. The HP turbine disc 22 is provided with a lip 26 on its rear face into which is slid the rear seal plate 24. The rear seal plate is held in its circumferential and axial position by a locking plug 28 that is held in place by a retaining wire 29. The locking plug is releasable by removing the retaining wire.

The retaining wires can work loose during operation. A borescope 30 is inserted into the engine casing through an access aperture to inspect each component. An access aperture in the IP casing is adjacent the borescope guide tube 20 that directs the borescope 30 towards the centre of the engine. Once the borescope tip is in the rear cavity 32 of the HP turbine disc the articulated end of the borescope is turned to view the rear of the HP turbine disc, the rear seal plate lock plugs and the retaining wires.

In this position it is possible to inspect the lock plugs and be satisfied that they are secure. The turbine is rotated and all the lock plugs on the disc are inspected. The visual inspection is made through the borescope with the image examined by the operator via an eye-piece, or on a display.

If the retaining wires are all present and correctly located it is possible to secure the lock plugs with an adhesive. If a retaining wire is missing then it may be necessary to schedule an immediate engine service to replace and refit the missing part. It is possible that upon inspection the retaining wire may be in the process of working loose. By applying an adhesive to the lock plug and /or retaining wire it is possible to secure the lock plug and/or retaining wire in place to allow the engine to run until its next scheduled service, where the part may be refitted or replaced.

Figure 4:
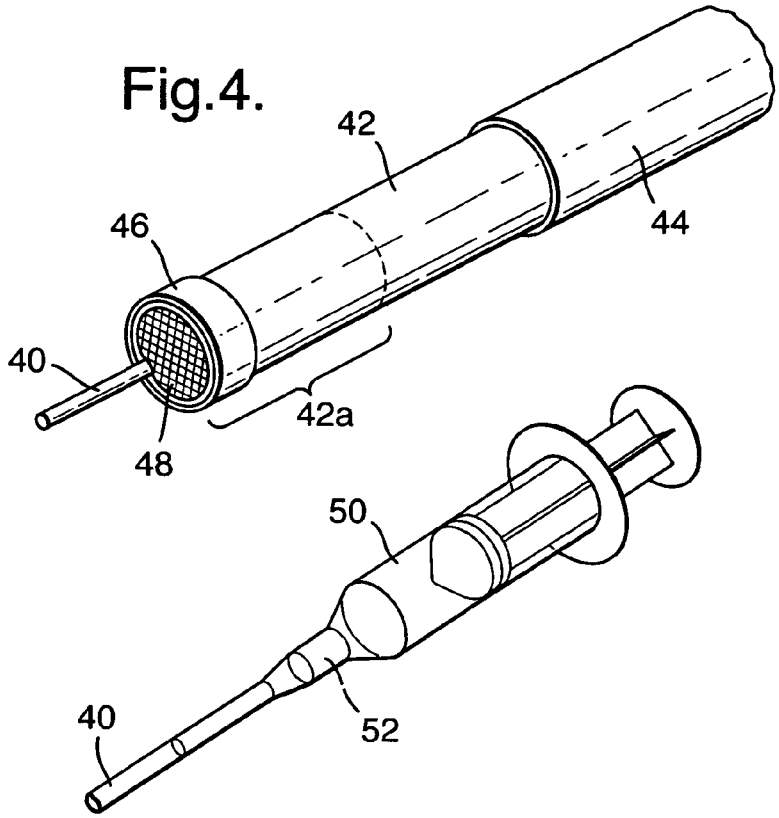
FIG. 4 depicts part of a borescope/microbore tubing assembly

The adhesive is supplied to the lock plugs using the following method. Firstly, the borescope 42, an IF2D5-12 Olympus fibrescope is pulled from the engine after the inspection and an assembly created by attaching a microbore delivery conduit 40 thereto, part of the assembly is depicted in FIG. 4. Both the borescope and the delivery conduit are fed through a length of heatshrink tubing 44. A further, shorter, length of heatshrink tubing 46 is placed over the articulated tip section 42*a* of the borescope and microbore tubing and subsequently both lengths of heatshrink tubing are heat treated by a heat gun to shrink the tubing and secure the conduit to the borescope. The delivery end of the microbore conduit 40 is visible to the imaging element 48 of the borescope. Thus, the microbore conduit 40 is attached to the exterior of the borescope 42.

An adhesive, such as Sauereisen 315, which is a two-part, chemical setting cement consisting of a powder and a liquid which are mixed together as used, is mixed and drawn or poured into a syringe 50. A needle 52 is attached to the syringe 50 and inserted into the supply end of the delivery tube 40. Pressure is applied to the plunger 54 of the syringe to supply adhesive through the delivery tube 40.

As the adhesive is chemical setting there is a maximum time within which the adhesive may be used. The time is reduced as the ambient temperature increases. The turbine section of a gas turbine engine can be exposed to temperatures approaching 1600 K and consideration must be made of the internal temperature of the engine, which after operation is significantly higher than the ambient temperature outside the engine. However, it is beneficial for the cure rate if there is some residual warmth remaining in the engine to aid the cure process.

If the engine has been in service and is post flight the securing process should not be performed before 8 hours from shutdown and the securing process should be completed within 12 hours of shutdown to allow the adhesive time to cure whilst the engine retains its residual temperature. If an attempt is made to perform the securing operation before 8 hours from shutdown there is a possibility that the adhesive will set too early in addition to possible damage to the borescope.

If the engine is not post flight it is desirable to operate the engine for a short ground idle run and to begin the securing process not before 5 and a half hours from shutdown of the ground idle run. The securing process should be complete within 9 and a half hours from the shutdown.

The combined borescope and delivery tube assembly is inserted into the guide tube 20 till the tip of the borescope is in the rear cavity 32 of the high pressure turbine disc 22. The articulated end 42*a* of the borescope is turned to view the lock plugs and retaining wires. The tip of the delivery tube is manoeuvred with the borescope so that it touches a lock plug.

Figure 5:
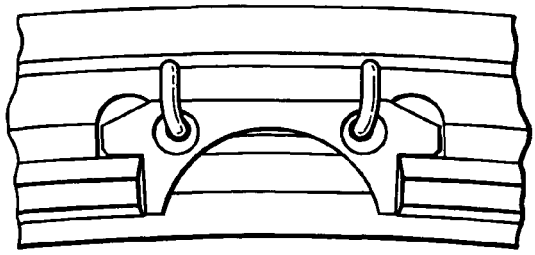
FIG. 5 depicts the locations to which adhesive is applied.
Figure 5:
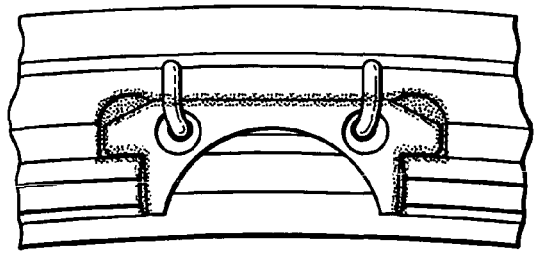

Adhesive is applied to the lock plug at the locations depicted in FIG. 5. Adhesive is supplied around the periphery of the lockplug and additionally to the orifices through which the retaining protrude. The tip of the delivery tube is manoeuvred by articulating the borescope and inserting and withdrawing the assembly.

Once adhesive is applied to the first lock plug the HP disc is rotated and adhesive applied to the remaining lock plugs in sequence.

Once the adhesive is applied to all the lock plugs it is possible to inspect them by further rotating the HP disc. If a deficiency is noted it is possible to apply further adhesive as desired. Once satisfied that all the lock plugs are correctly secured with the adhesive the borescope/delivery tube can be removed.

Beneficially, the delivery tube can be removed from the borescope and disposed of.

Various modifications may be made without departing from the scope of the invention. For example, the delivery tube may be used to deliver other fluids to the same or other locations in the engine. For example, the fluid may be a cleaning fluid to prepare the surface to which the adhesive is to be applied. The delivery tube may also deliver solid objects to a remote site. The solid objects may be a powder in air carrier, or a powder dispersed in a liquid medium. The maximum diameter of the powder particles must, of course, be less than the inside diameter of the tube used.

The solid objects may be used as a filler for damping, or may be used to distribute weight on a disc, perhaps for improving the balance of the disc.

Whilst the specific embodiment has been described with respect to lock plugs for a HP turbine it will be appreciated that the invention is equally applicable for use in securing other components and for use in other assembled engines. Particularly where the components are internally located and access is difficult.

The invention claimed is:

1. A method of securing a releasable component in an assembled engine, the method comprising:

attaching a delivery conduit to an exterior of a borescope using heatshrink tubing, inserting the borescope and the conduit through an aperture in a casing of the engine, the conduit being carried by the borescope, directing the borescope to the releasable component, and supplying an adhesive onto the releasable component through the conduit.

2. A method according to claim 1, wherein the releasable component is lock plug for a turbine.

3. A method according to claim 1, wherein the casing is a turbine case.

4. A method according to claim 2, wherein the casing is a turbine case.

5. A method according to claim 1, wherein the method further comprises running the engine, shutting down the engine, and supplying the adhesive while the engine retains a residual temperature.

6. A method according to claim 5, wherein the shutting down of the engine occurs post flight, and the adhesive is supplied between 8 hours and 12 hours from shutdown.

7. A method according to claim 5, wherein the shutting down of the engine occurs after a ground idle run, and the adhesive is supplied between 5 hours and 9 hours from shutdown.

8. A method according to claim 1, wherein the adhesive is a chemical setting adhesive.

9. A method of claim 1, wherein a delivery end of the conduit is visible to an imaging element of the borescope.

10. A method of securing a releasable component in an assembled engine, the method comprising:

attaching a delivery conduit to an exterior of a borescope using heatshrink tubing, inserting the borescope and delivery tube into the engine, supplying a fluid to a remote site through the delivery conduit, removing the borescope and delivery tube from the engine, and removing the delivery tube from the borescope and disposing of the delivery tube.

11. A method according to claim 10, wherein the fluid is an adhesive.

12. A method according to claim 11, wherein the adhesive is a chemical setting adhesive.

13. A method according to claim 10, wherein the fluid is a cleaning fluid to prepare a surface.

14. A method of claim 10, wherein a delivery end of the conduit is visible to an imaging element of the borescope.

15. A method of securing a releasable component in an assembled engine, the engine including a casing that defines an aperture, the method comprising:

inserting a conduit through the aperture of the casing, carrying the conduit on an exterior of a borescope through the aperture with the borescope, directing the borescope to the releasable component, and supplying an adhesive onto the releasable component through the conduit.

16. A method according to claim 15, wherein the conduit is removed from the borescope following the supplying of the adhesive.

17. A method according to claim 15, wherein the borescope is isolated from the adhesive.

18. A method according to claim 15, wherein the adhesive is a chemical setting adhesive.

19. A method according to claim 15, wherein the conduit is attached to the borescope using heatshrink tubing.

20. A method according to claim 15, wherein a distal end of the conduit is spaced from a distal end of the borescope in an axial direction.

21. A method of claim 15, wherein an axis of the conduit is spaced from an axis of the borescope in a radial direction.

22. A method of claim 15, wherein a delivery end of the conduit is visible to an imaging element of the borescope.

* * * * *